US009903385B2

(12) United States Patent
Kawanishi et al.

(10) Patent No.: US 9,903,385 B2
(45) Date of Patent: Feb. 27, 2018

(54) IMPELLER, ROTARY MACHINE INCLUDING THE SAME, AND METHOD FOR MANUFACTURING IMPELLER

(75) Inventors: Daisuke Kawanishi, Tokyo (JP); Akihiro Nakaniwa, Tokyo (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 661 days.

(21) Appl. No.: 13/812,617

(22) PCT Filed: Dec. 13, 2011

(86) PCT No.: PCT/JP2011/078790

§ 371 (c)(1),
(2), (4) Date: Jan. 28, 2013

(87) PCT Pub. No.: WO2013/031038

PCT Pub. Date: Mar. 7, 2013

(65) Prior Publication Data

US 2014/0050585 A1 Feb. 20, 2014

(30) Foreign Application Priority Data

Aug. 29, 2011 (JP) ..... 2011-185838

(51) Int. Cl.
*F04D 29/28* (2006.01)
*F04D 29/02* (2006.01)
(Continued)

(52) U.S. Cl.
CPC ..... *F04D 29/28* (2013.01); *F04D 29/023* (2013.01); *F04D 29/2277* (2013.01);
(Continued)

(58) Field of Classification Search
CPC ..... F04D 29/28; F04D 29/284; F04D 29/023; F04D 29/2277
See application file for complete search history.

(56) References Cited

U.S. PATENT DOCUMENTS 2,438,866 A 3/1948 Rockwell et al.
2,613,609 A 10/1952 Buchi
(Continued)

FOREIGN PATENT DOCUMENTS

CN 2069501 1/1991
CN 1300350 6/2001
(Continued)

OTHER PUBLICATIONS

Chinese Office Action dated Jan. 6, 2015 in corresponding Chinese Patent Application No. 201180036597.X with English translation.
(Continued)

*Primary Examiner* — Igor Kershteyn
*Assistant Examiner* — Brian P Wolcott
(74) *Attorney, Agent, or Firm* — Wenderoth, Lind & Ponack, L.L.P.

(57) ABSTRACT

An impeller including: blades disposed in a circumferential direction of the impeller; a disk located close to a second end side of an axis of the impeller with respect to the blades, to which the blades are attached, and configured to be attached to a rotating shaft; and a shroud located close to a first end side of an axis of the impeller with respect to the blades, and to which the blades are attached. Flow passages are formed by the blades, the disk and the shroud. The blades, the shroud and a first portion of the disk close to the second end side of the axis of the impeller are integrated so as to form a first member. A second portion of the disk close to the first end side of the axis of the impeller forms a second member.

14 Claims, 8 Drawing Sheets

(51) Int. Cl.
*F04D 29/60* (2006.01)
*F04D 29/22* (2006.01)

(52) U.S. Cl.
CPC ..... *F04D 29/284* (2013.01); *F04D 29/601* (2013.01); *Y10T 29/49332* (2015.01)

(56) References Cited

U.S. PATENT DOCUMENTS

| | | | |
|---|---|---|---|
| 2,799,445 | A | 7/1957 | Hull |
| 4,173,429 | A | 11/1979 | Hoffman et al. |
| 4,183,719 | A | 1/1980 | Bozung |
| 4,220,372 | A | 9/1980 | Johansen et al. |
| 4,231,706 | A | 11/1980 | Ueda et al. |
| 4,602,411 | A | 7/1986 | Brown |
| 4,697,987 | A | 10/1987 | Katayama et al. |
| 4,795,311 | A | 1/1989 | Arkhipov et al. |
| 4,986,736 | A | 1/1991 | Kajiwara et al. |
| 6,481,970 | B2 | 11/2002 | Mukherjee et al. |
| 7,341,430 | B2 | 3/2008 | Sano et al. |
| 2010/0008775 | A1 | 1/2010 | Vedsted et al. |
| 2010/0037458 | A1 | 2/2010 | Ranz et al. |
| 2010/0189568 | A1 | 7/2010 | Watanabe et al. |
| 2011/0200439 | A1 | 8/2011 | Nakaniwa et al. |
| 2014/0064975 | A1 | 3/2014 | Yagi et al. |

FOREIGN PATENT DOCUMENTS

| | | |
|---|---|---|
| CN | 2763589 | 3/2006 |
| CN | 101255871 | 9/2008 |
| CN | 205117803 | 3/2016 |
| DE | 755 198 | 11/1952 |
| DE | 44 27 115 | 4/1995 |
| DE | 10 2009 031 737 | 7/2011 |
| EP | 0 283 825 | 7/1992 |
| FR | 1471604 | 3/1967 |
| JP | 55-4376 | 1/1980 |
| JP | 55-5456 | 1/1980 |
| JP | 58-72491 | 5/1983 |
| JP | 61-142393 | 6/1986 |
| JP | 61-212601 | 9/1986 |
| JP | 4-31695 | 2/1992 |
| JP | 2788818 | 8/1998 |
| JP | 2001-355595 | 12/2001 |
| JP | 2002-235694 | 8/2002 |
| JP | 2003-293988 | 10/2003 |
| JP | 2004-036444 | 2/2004 |
| JP | 2004-60460 | 2/2004 |
| JP | 2004-308647 | 11/2004 |
| JP | 2008-223540 | 9/2008 |
| JP | 2009-156122 | 7/2009 |
| JP | 4428044 | 3/2010 |
| JP | 2010-230012 | 10/2010 |
| JP | 2010-285919 | 12/2010 |
| JP | 2012-172645 | 9/2012 |
| JP | 2013-139753 | 7/2013 |

OTHER PUBLICATIONS

Yuxin Cai, "Improvement in Process of Manufacturing an Impeller for a Centrifugal Drum Pressure Fan," Mechanical and Electrical Engineering Technology, No. 4, pp. 58-60, Aug. 30, 2001, cited in Office Action.

Extended European Search Report dated Jul. 24, 2015 in corresponding European Patent Application No. 11869760.6.

International Search Report dated Mar. 19, 2012 in International (PCT) Application No. PCT/JP2011/078790 with English translation.

International Search Report dated May 22, 2012 in International (PCT) Application No. PCT/JP2012/053783 with English translation.

Written Opinion of the International Searching Authority dated Mar. 19, 2012 in International (PCT) Application No. PCT/JP2011/078790 with English translation.

Written Opinion of the International Searching Authority dated May 22, 2012 in International (PCT) Application No. PCT/JP2012/053783 with English translation.

Office Action dated Jan. 26, 2016 in corresponding U.S. Appl. No. 13/976,108.

International Search Report dated Mar. 12, 2013 in corresponding International (PCT) Application No. PCT/JP2012/083427 with English translation.

Written Opinion of the International Searching Authority dated Mar. 12, 2013 in International (PCT) Application No. PCT/JP2012/083427 with English translation.

Extended European Search Report dated May 18, 2015 in corresponding European Application No. 12861319.7.

First Office Action dated May 29, 2015 in corresponding Chinese Application No. 201280019373.2 with English translation.

Office Action dated Apr. 1, 2016 in U.S. Appl. No. 14/114,584.

Final Office Action dated Jul. 27, 2016 in corresponding U.S. Appl. No. 13/976,108.

Final Office Action dated Sep. 9, 2016 in U.S. Appl. No. 14/114,584.

Notice of Allowance dated Nov. 18, 2016 in corresponding U.S. Appl. No. 13/976,108.

Advisory Action dated Jan. 11, 2017 in U.S. Appl. No. 14/114,584.

Notice of Allowance dated Feb. 8, 2017 in U.S. Appl. No. 14/114,584.

IMPELLER, ROTARY MACHINE INCLUDING THE SAME, AND METHOD FOR MANUFACTURING IMPELLER

TECHNICAL FIELD

The present invention relates to an impeller in rotary machines, such as a centrifugal compressor, a rotary machine including the impeller, and a method for manufacturing the impeller. Priority is claimed on Japanese Patent Application No. 2011-185838, filed Aug. 29, 2011, the content of which is incorporated herein by reference.

BACKGROUND ART

As shown in FIGS. 12 and 14, generally, an impeller 101 used for rotary machines, such as a centrifugal compressor, has a fixed hub portion 112 of a rotating shaft S, a disc-shaped disc 107 that is provided integrally with the hub portion 112, a shroud 108 that is arranged so as to be spaced apart from the disc 107 in the axial direction of the central axis L, and a plurality of blades 106 that are provided in a circumferential direction and connect the disc 107 to the shroud 108. In this type of impeller, a portion surrounded by the side surfaces of the blades 106 and two mutually facing surfaces of the disc 107 and the shroud 108 formed a flow passage 103 for compressing air. Additionally, by shrink-fitting the hub portion 112 to the rotating shaft S of the rotary machine, the impeller 101 is fixed to the rotating shaft S.

The flow passage 103 opens toward a first end side of the central axis L on the inner peripheral side, curves gradually so as to be directed to a radial outer peripheral side, and opens toward the radial direction on outer peripheral side. That is, the flow passage 103 is formed in a curved shape as viewed from the circumferential direction in order to direct a fluid, which is introduced from the first end side along a second end side, to the radial outer peripheral side (particularly, refer to FIG. 14). Moreover, as shown in FIG. 13, as the blades 106 are obliquely connected to the disc 107, the compression performance of the impeller 101 is improved, and thereby, the flow passage 103 assumes a complicated three-dimensional shape.

As a method for manufacturing the impeller 101, a method in which the blades 106 and one of the disc 107 and the shroud 108 are integrally formed, the other of the disc and shroud is separately manufactured, and these disc and shroud are integrated by welding or brazing, is known. Additionally, since the impeller requires high rigidity, a one-piece impeller with high strength reliability is manufactured by shaving out the disc 107, the shroud 108, and the blade 106 from a single base material (for example, refer to PTL 1).

CITATION LIST

Patent Literature

[PTL 1] Japanese Patent Application, First Publication No. 2010-285919

SUMMARY OF INVENTION

Problem to Be Solved by the Invention

Incidentally, as described above, the flow passage 103 of the impeller 101 has a complicated shape having a curved portion, and the inside of the flow passage is narrow.

Therefore, during the manufacture of the one-piece impeller 101, it is necessary to perform complicated cutting while inserting, for example, machining members, such as an electrode for machining, from positions to be used as an inlet and an outlet of the flow passage 103. Additionally, in the manufacturing method as described in PTL 1, it is necessary to form the flow passage using a special machining member and substantial manufacturing costs are incurred.

The present invention has been made in consideration of such a situation, and an object thereof is to provide an impeller, a rotary machine including the impeller, and a method for manufacturing the impeller that maintains the performance of the related art while being capable of being manufactured at low cost.

Means for Solving the Problem

In order to achieve the above object, an impeller related to a first aspect of the present invention is an impeller including a plurality of blades disposed in a circumferential direction of the impeller, in which each of the blades directs outward from inward in a radial direction of the impeller; a shroud located close to a first end side of an axis of the impeller with respect to the blades, and to which the blades are attached; and a disk located close to a second end side of an axis of the impeller with respect to the blades, to which the blades are attached, and configured to be attached to a rotating shaft. A plurality of flow passages are formed by the blades, the disc, and the shroud. The blades, the shroud and a first portion of the disk close to the second end side of the axis of the impeller are integrated so as to form a first member. A second portion of the disk close to the first end side of the axis of the impeller forms a second member.

According to the first aspect of the present invention, when a flow passage portion of the first member is formed by splitting the impeller into the first member and the second member and making the second member into a part that constitutes the portion of the disc on the first end side, the accessibility of the machining tool improves. That is, when the machining tool is inserted from a position to be used as the outlet of the flow passage, the machining when forming the flow passage becomes easy by making a part that becomes an interference object, on the inner peripheral side, into a separate second member. Additionally, when the machining tool is inserted from a position to be used as the introduction port that is the inlet of the flow passage, the machining of the introduction port becomes easy by making a part that becomes an interference object into a separate second member. Thereby, the manufacturing time can be shortened, and the manufacturing costs can be kept down.

In a second aspect of the present invention, in the above impeller, at least one of mutually facing surfaces of the disc and the shroud in the first member is formed into a flat surface.

According to the second aspect of the present invention, the shape of the flow passage defined by the disc, the shroud, and the blades are further simplified. Therefore, the accessibility of the machining tool can be improved and the man-hours of machining when forming the flow passage can be further reduced.

In a third aspect of the present invention, in the above impeller, both of the mutually facing surfaces of the disc and the shroud in the first member are formed into flat surfaces.

According to the third aspect of the present invention, a curved portion is eliminated in a cross-sectional shape when viewed from the circumferential direction in the shape of the flow passage defined by the disc, the shroud, and the blades.

Therefore, the man-hours of machining when forming the flow passage can be further reduced.

In a fourth aspect of the present invention, in the impeller of any one aspect of the second and third aspects, the blades are provided within a range of the flat surface of the disc or the shroud as viewed from the axial direction.

According to the fourth aspect of the present invention, the shape of the flow passage defined by the disc, the shroud, and the blades are further simplified. Therefore, the accessibility of the machining tool can be improved and the man-hours of machining when forming the flow passage can be further reduced.

In a fifth aspect of the present invention, in the impeller of any one aspect of the first to four aspects, the surface of the second member that faces the first end side is formed in a curved shape so as to be directed to the radial outer peripheral side as it goes from the first end side to the second end side.

According to the fifth aspect of the present invention, a fluid introduced into the impeller can be guided to the flow passage without any delay by the surface of the second member that faces the first end side. This can maintain the compression performance of the impeller.

In a sixth aspect of the present invention, in the impeller of any one aspect of the first to fifth aspects, the first member has a fixed portion that is fixed to the rotating shaft.

According to the sixth aspect of the present invention, the impeller can be more firmly fixed to the rotating shaft compared to a case where the second member equivalent to a hub portion of a disc of the related art is fixed to the rotating shaft after the first member and the second member are integrated. That is, the impeller can be more firmly fixed to the rotating shaft by directly fixing the first member, which has a weight more than the second member, to the rotating shaft.

In a seventh aspect of the present invention, in the impeller of any one aspect of the first to sixth aspects, the surface of the blade that forms the flow passage is formed so as to be orthogonal to the surface of the disc that faces the shroud.

In the seventh aspect of the present invention, the shape of the blade is further simplified as compared to a shape where the surface of the blade that forms the flow passage inclines with respect to the disc. Therefore, the man-hours of machining when forming the flow passage can be further reduced.

Additionally, an eighth aspect of the present invention provides a rotary machine including the impeller related to any one aspect of the first to seventh aspects.

By adopting the above impeller, the rotary machine can be provided at low costs.

Additionally, a method for manufacturing an impeller related to a ninth aspect of the present invention is a method for manufacturing an impeller including a plurality of blades disposed in a circumferential direction of the impeller, in which each of the blades directs outward from inward in a radial direction of the impeller; a shroud located close to a first end side of an axis of the impeller with respect to the blades, and to which the blades are attached; and a disk located close to a second end side of an axis of the impeller with respect to the blades, to which the blades are attached, a plurality of flow passages being formed by the blades, the disc, and the shroud. The method for manufacturing an impeller includes a first member forming step of performing cutting on a base material for forming the second end side of the axis of the impeller to form the flow passages, and forming a first member in which the blades, the shroud, and a first portion of the disc close to the second end side of the impeller are integrally formed; and a second member forming step of forming a second member that constitutes a second portion of the disc close to the first end side of the impeller.

According to the ninth aspect of the present invention, after the impeller is split into the first member and the second member, these members are formed in separate steps, and the second member formed in the second member forming step is made into a part that constitutes the portion of the disc on the first end side. This improves the accessibility of a machining tool when a flow passage portion of the first member is formed. That is, when the machining tool is inserted from a position to be used as the outlet of the flow passage, the machining when forming the flow passage becomes easy by making a part that becomes an interference object on the inner peripheral side into a separate second member. Additionally, when the machining tool is inserted from a position to be used as the introduction port that is the inlet of the flow passage, the machining of the introduction port becomes easy by making a part that becomes an interference object into a separate second member. Thereby, the manufacturing time can be shortened, and the manufacturing costs can be kept down.

In a tenth aspect of the present invention, in the above method for manufacturing an impeller, in the second member forming step, the surface of the second member that faces the first end side is formed with a curved portion that is directed to the radial outer peripheral side as it goes from the first end side to the second end side.

According to the tenth aspect of the present invention, the air introduced into the impeller including the second member formed by the second member forming step can be guided to the flow passage without any delay by the surface of the second member that faces the first end side. Therefore, the performance of the impeller does not degrade.

Advantageous Effects of Invention

According to the present invention, the accessibility of a machining tool improves when a flow passage portion of the impeller is formed. Therefore, the manufacturing time can be shortened and the manufacturing costs can be kept down.

DESCRIPTION OF EMBODIMENTS

Figure 1:
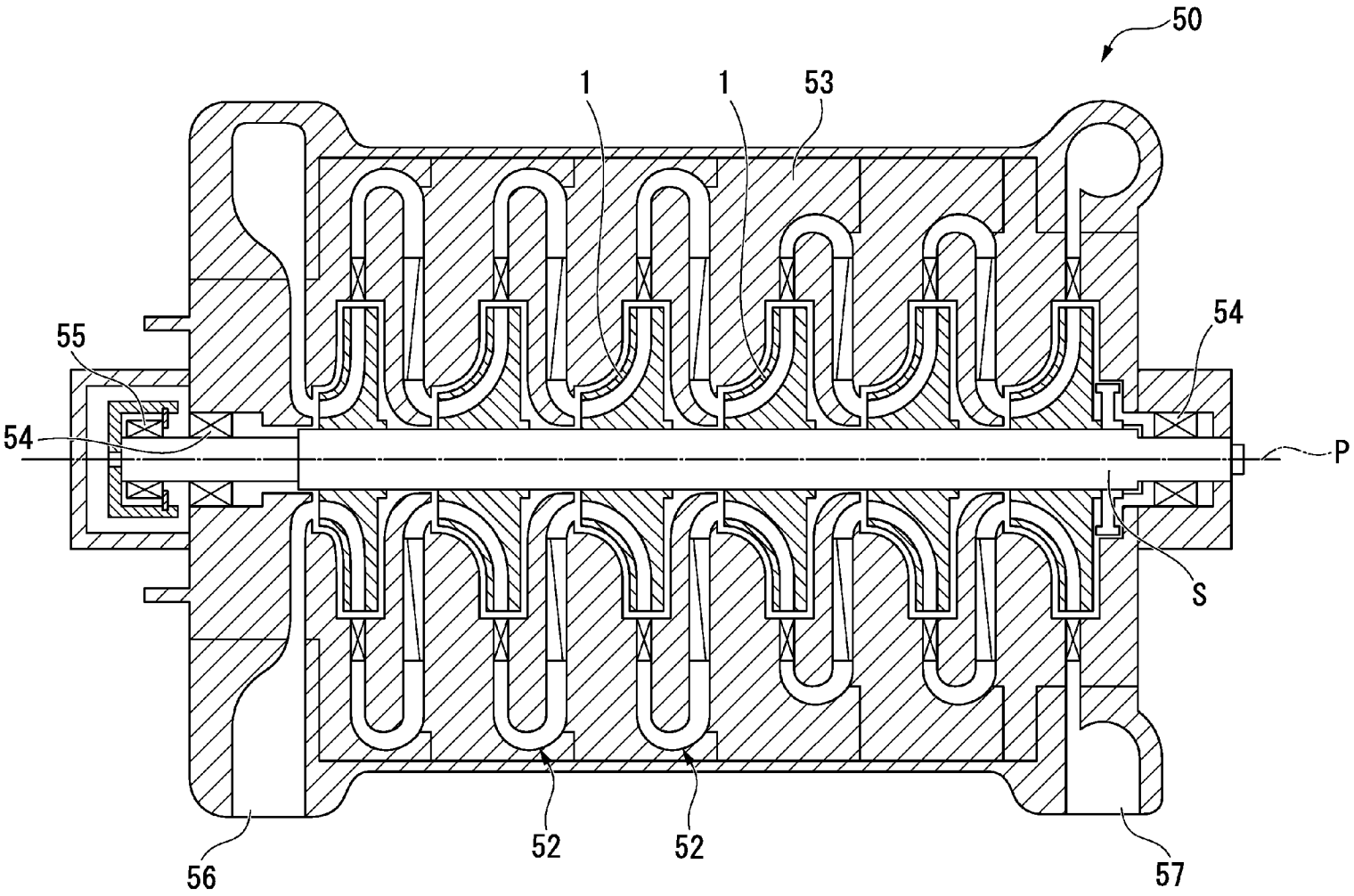
FIG. 1 is a cross-sectional view showing a centrifugal compressor to which impellers of an embodiment of the present invention is applied.

An embodiment of the present invention will be described in detail referring to the drawings.

A centrifugal compressor 50 is shown as an example of a rotary machine of the present embodiment in FIG. 1. The centrifugal compressor 50 is mainly constituted by a rotating shaft S that is rotated around an axis P, impellers 1 that are attached to the shaft S and compress a fluid utilizing centrifugal force, and a casing 53 that rotatably supports the rotating shaft S and is formed with flow passages 52 that allow the fluid to flow therethrough from the upstream to the downstream.

The casing 53 is formed so as to form a substantially columnar outline, and the rotating shaft S is arranged so as to pass through the center of the casing. Journal bearings 54 are provided at both axial ends of the rotating shaft S of the casing 53, and a thrust bearing 55 is provided at one end of the rotating shaft. The journal bearings 54 and the thrust bearing 55 rotatably support the rotating shaft S. That is, the rotating shaft S is supported by the casing 53 via the journal bearings 54 and the thrust bearing 55.

Additionally, a suction port 56 into which a fluid is made to flow from the outside is provided on one end side of the casing 53 in the axial direction, and a discharge port 57 through which the fluid flows out to the outside is provided on the other end side. An internal space, which communicates with the suction port 56 and the discharge port 57, respectively, and repeats diameter reduction and diameter increase, is provided within the casing 53. This internal space functions as a space that accommodates the impeller 1, and also functions as the above flow passages 52. That is, the suction port 56 and the discharge port 57 communicate with each other via the impellers 1 and the flow passages 52.

A plurality of impellers 1 is arranged at intervals in the axial direction of the rotating shaft S. In addition, although six impellers 1 are provided in the illustrated example, at least one or more impellers may be provided.

Figure 2:
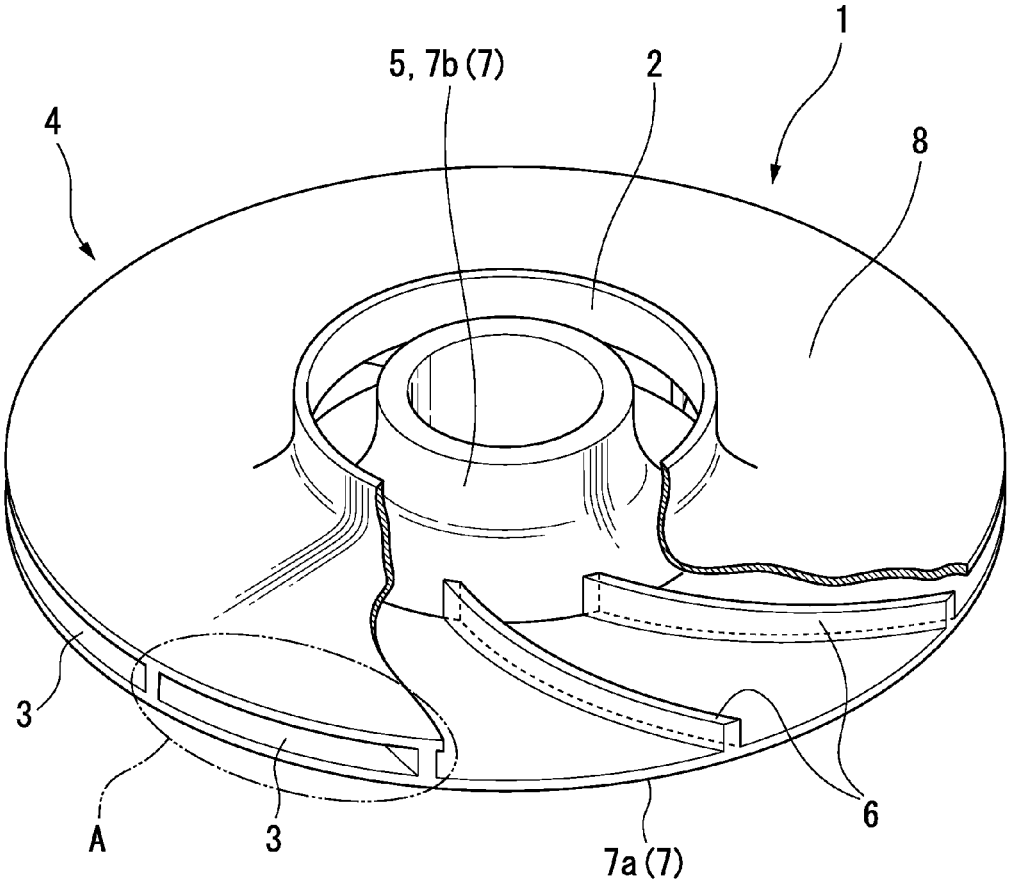
FIG. 2 is a perspective view showing an impeller of the embodiment of the present invention.
Figure 4:
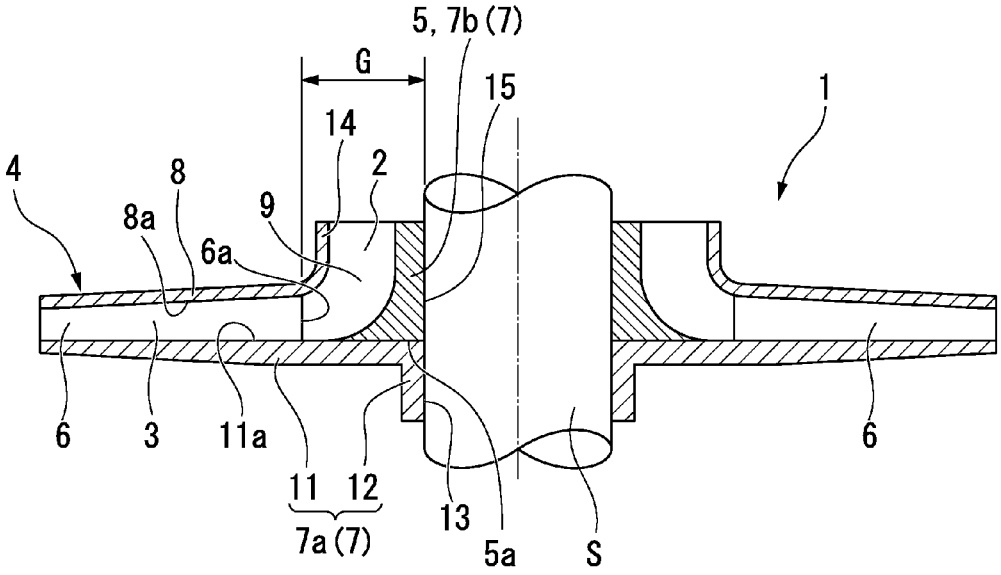
FIG. 4 is a cross-sectional view of the impeller of the embodiment of the present invention.

As shown in FIGS. 2 and 4, the impeller 1 has a substantially disc shape, and is configured so that a fluid suctioned from an introduction port 2 that opens to a first side in the direction (hereinafter referred to as an axial direction) of a central axis L is discharged toward the radial outer peripheral side via flow passages 3 formed inside the impeller 1.

In addition, in the following, the outer peripheral side of the impeller 1 in the radial direction is simply referred to as outer peripheral side. Additionally, the inner peripheral side of the impeller 1 in the radial direction is simply referred to as inner peripheral side. Additionally, the upper side of FIGS. 2 and 4 that becomes the upstream side of the fluid is referred to as a first end side, and the lower side of FIGS. 2 and 4 that becomes the downstream side of the fluid is referred to as a second end side.

The impeller 1 of the present embodiment is equipped with a substantially disc-shaped first member 4 that forms the second end side, and a substantially cylindrical second member 5 that forms the first end side and that has an outer peripheral surface that is gradually increased in diameter toward the second end side. A disc 7 that is fixed to the rotating shaft S in the impeller 1, a plurality of blades 6 that are provided in the circumferential direction on the first end side of the disc 7 so as to be directed from the inner peripheral side to the outer peripheral side, and a shroud 8 that is provided to face the disc 7 on the first end side and is attached to the blades 6 are constituted by the first member 4 and the second member 5. The first member 4 and the second member 5 are not fixed to each other in the present embodiment but are fixed to the rotating shaft S, respectively, whereby the introduction port 2 is defined between the first member 4 and the second member 5, and the first member 4 and the second member 5 further defines a suction portion 9 that connects the introduction port 2 and the flow passages 3.

The first member 4 is arranged from the radial inner peripheral side toward the radial outer peripheral side. The first member 4 is equipped with a plurality of blades 6 disposed in a circumferential direction of the impeller, a first portion 7*a* that is provided on the second end side of the blades 6 and constitutes the second end side of the disc 7 to which the blades 6 are attached, and the shroud 8 that is provided on the first end side of the blades 6 and has the blades 6 attached thereto. That is, the shroud 8 is arranged so as to be spaced apart from the first portion 7*a* of the disc 7 by a predetermined distance. The first member 4 is formed from, for example, precipitation-hardened stainless steel.

The first portion 7*a* of the disc 7 includes a fixed portion 12 that is fixed to the rotating shaft S, and a disc body portion 11 that is formed integrally with the fixed portion 12 and has a substantially disc shape.

The fixed portion 12 is formed in a cylindrical shape that has a fitting hole 13, which penetrates in the axial direction, at a central portion thereof. The fitting hole 13 is a hole that is inserted and fitted to the rotating shaft S when the impeller 1 is fixed to the rotating shaft S. The disc body portion 11 has a substantially circular shape as viewed from the axial direction and is formed at one axial end of the fixed portion 12. Additionally, one surface 11*a* of the disc body portion 11 on the first end side is formed into a substantially flat surface.

In other words, the fixed portion 12 is a columnar part that protrudes to the second end side in the central portion of the disc body portion 11. The fixed portion 12 protrudes to the second end side by a predetermined amount. This protruding amount is appropriately set according to a fastening force required in order to shrink-fit and fix the impeller 1 to the rotating shaft S.

The plurality of blades 6 are provided in the one surface 11*a* of the disc body portion 11. The plurality of blades 6 have a constant plate thickness (blade thickness), respectively, and are provided at regular intervals in the circumferential direction in a substantially radial shape from the radial inner peripheral side toward the radial outer peripheral side. Additionally, the blades 6 extend so as to curve toward one direction in the circumferential direction as they go from the radial inner peripheral side of the disc 7 to the radial outer peripheral side, respectively.

Additionally, an inner end portion 6*a* of the blade 6 on the radial inner peripheral side is spaced apart from an inner peripheral surface 13*a* of the fitting hole 13 by a predetermined distance G This distance G is appropriately set according to the shapes or the like of the suction portion 9 and the flow passages 3 that communicate with the suction portion 9, and is set so as to be located closer to the outer peripheral side than an outer peripheral end of the second member 5.

The shroud 8 is a substantially disc-shaped member that is provided integrally with the blades 6 so as to cover the plurality of blades 6 from the first end side. The shroud 8 is formed in the shape of a disc centered on the central axis L. Specifically, the shroud 8 is formed in the shape of an umbrella that is gradually reduced in diameter as it goes to the first end side. Additionally, the radial inner peripheral side of the shroud 8 constitutes a cylindrical portion 14 that rises to the first end side. The cylindrical portion 14 defines the introduction port 2 together with a smaller-diameter surface 17 (refer to FIG. 5) of the second member 5 by combining the first member 4 and the second member 5.

Additionally, a range where the blades 6 are formed, in the other surface 8*a* of the shroud 8 on the second end side, that is, the surface of the shroud 8 that faces the one surface 11*a* of the disc 7, is formed into a substantially flat surface. That is, as for the other surface 8*a* of the shroud 8, a cross-section perpendicular to the axial direction in the range where the blades 6 are formed can be drawn in a straight line.

Figure 3:
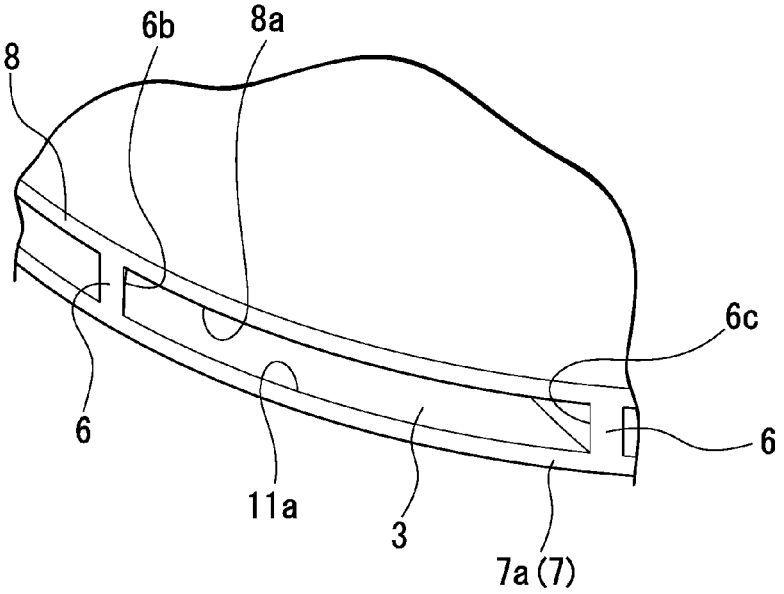
FIG. 3 is an enlarged view of a part A of FIG. 2.

As shown in FIG. 3, the flow passage 3 is formed between the blades 6, the first portion 7*a* of the disc 7, and the shroud 8. In other words, the flow passage 3 is configured by a space surrounded by the one surface 11*a* of the disc 7, the other surface 8*a* that is the surface of the shroud 8 on the second end side, and a surface 6*b* of one blade 6 on the other circumferential side, and a surface 6*c* of the other blade 6 on one circumferential side, in the blades 6 that are adjacent to each other.

Additionally, in the present embodiment, the blade 6 is provided so as to become substantially perpendicular to the one surface 11*a* of the disc 7. In other words, the cross-sectional shape of the flow passage 3 defined by the blades 6, the disc 7, and the shroud 8 becomes rectangular. That is, the surfaces of the blades 6 that form the flow passage 3 are formed so as to be substantially orthogonal to the one surface 11*a* of the disc 7.

The second member 5 has the second portion 7*b* of the disc 7, and is a substantially cylindrical member centered on the central axis L. The second member 5 has the outer peripheral surface 16 that is gradually increased in diameter toward the second end side. A radial central portion of the second member 5 is formed with a second fitting hole 15 that has almost the same internal diameter as the fitting hole 13. Additionally, the other end surface 5*a* of the second member 5 is formed into a flat surface.

The outer peripheral surface 16 of the second member 5 includes the smaller-diameter surface 17 and an increased diameter surface 18. The smaller-diameter surface 17 including an end portion of the second member 5 on the first end side is formed so as to have the same diameter along the axial direction.

The increased diameter surface 18 including an end portion of the second member 5 on the second end side is formed into a curved surface that is gradually increased in diameter toward the other end surface 5*a*. The smaller-diameter surface 17 and the increased diameter surface 18 are gently connected. Additionally, the increased diameter surface 18 is formed so that the normal line of the increased diameter surface 18 substantially faces the axial direction on the other end portion.

That is, when the first member 4 and the second member 5 are combined, these members are formed so that the increased diameter surface 18 and the one surface 11*a* of the disc 7 are gently connected.

Additionally, the diameter of the other end surface 5*a* of the second member 5 is formed so as to become smaller than the internal diameter of the cylindrical portion 14 of the shroud 8.

In addition, the shape of the increased diameter surface 18 may be an oblique surface with a constant angle, without being limited to the curved surface as described above. Additionally, and in particular the smaller-diameter surface 17 does not need to be provided, and the outer peripheral surface 16 may be constituted only by the increased diameter surface 18.

Figure 5:
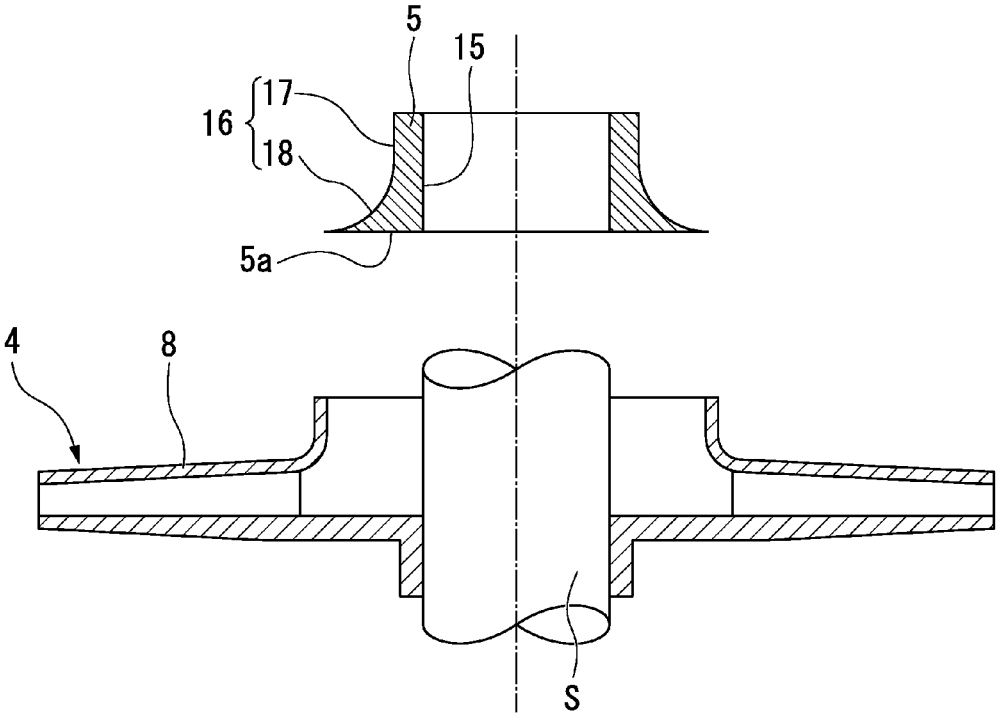
FIG. 5 is an exploded cross-sectional view of the impeller of the embodiment of the present invention.

Next, a method for assembling the impeller 1 of the present embodiment to the rotating shaft S will be described. First, as shown in FIG. 5, the inner peripheral surface of the fixed portion 12 of the first member 4 is fixed to the rotating shaft S by shrink-fitting. Specifically, the inner peripheral surface of the fitting hole 13 of the first member 4 is heated whereby the fitting hole 13 is increased in diameter, and in this state, the fitting hole 13 is inserted through the rotating shaft S. Then, the first member 4 and the rotating shaft S are integrally anchored by cooling the periphery of the fitting hole 13 to reduce the diameter thereof, and bringing the fitting hole 13 into contact with the outer peripheral surface of the rotating shaft S.

Next, similarly to the first member 4, the second member 5 is fixed to the rotating shaft S by shrink-fitting. In this case, the shrink-fitting is performed after the other end surface 5*a* of the second member 5 is made to abut against the one surface 11*a* of the disc 7 of the first member.

In addition, the order of being fixed to the rotating shaft S is not limited to the above-described order, and the first member 4 may be fixed to the rotating shaft S after the second member 5 is fixed to the rotating shaft S.

As described above, the impeller 1 is formed by the first member 4 and the second member 5 that are assembled to the rotating shaft S. As the other end surface 5*a* of the second member 5 and the one surface 11*a* of the first member 4 abut against each other, the relative positions of the first member 4 and the second member 5 are determined, and thereby, the introduction port 2 and the suction portion 9 are defined.

In addition, the assembling method is not limited to the above-described method, for example, a method for fixing the first member 4 and the second member 5 to the rotating shaft S after the second member 5 is joined to the first member 4 by methods, such as welding, may be used.

In the impeller 1 shown above, a fluid that has flowed in from the introduction port 2 is directed to the outer peripheral side from the inner peripheral side by the increased diameter surface 18 of the second member 5 in the suction portion 9. Next, the fluid that has flowed into the flow passages 3 from the suction portion 9 is accelerated by a centrifugal force generated by the rotation of the rotating shaft S by a driving source that is not shown, and is discharged from the outer peripheral ends of the flow passages 3.

A method for manufacturing the above-described impeller 1 of the present embodiment will be described. The method for manufacturing the impeller 1 related to the present embodiment has a first member forming step of forming the first member 4, and a second member forming step of forming the second member 5.

Figure 6:
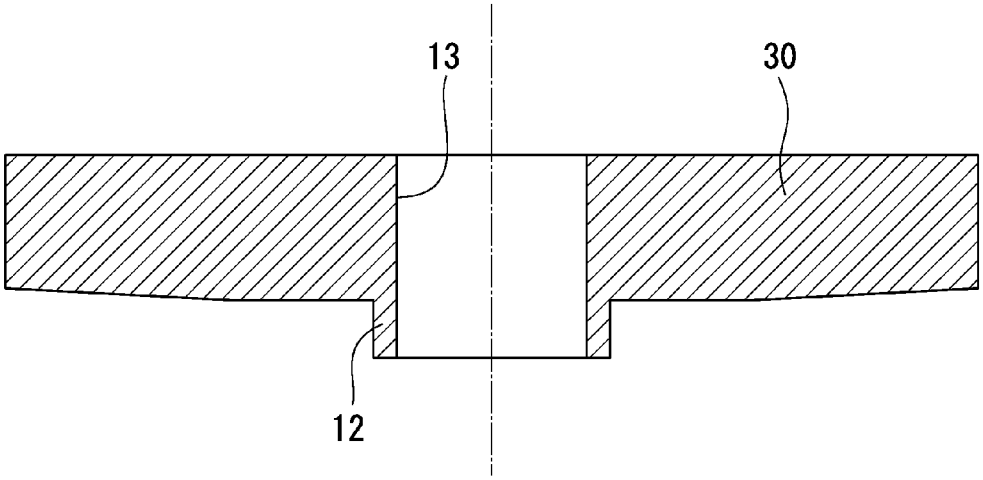
FIG. 6 is a view showing a manufacturing step of the impeller of the embodiment of the present invention.
Figure 7:
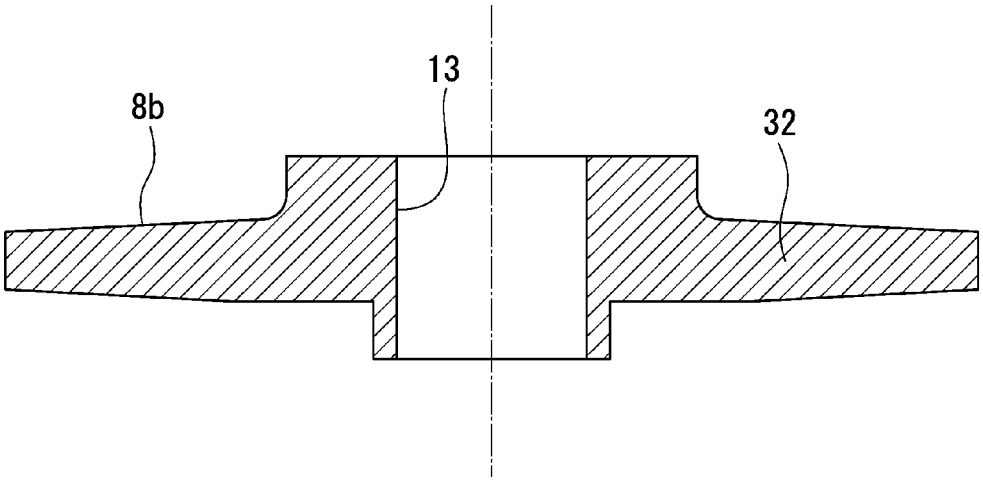
FIG. 7 is a view showing a manufacturing step of the impeller of the embodiment of the present invention.

The first member forming step has a first base material forming step and a cutting step. First, as shown in FIG. 6, as the first base material forming step, a substantially cylindrical base material 30, which is formed with the fitting hole 13 through which the rotating shaft S is inserted and the fixed portion 12, is forged. Then, as shown in FIG. 7, an inclined surface 8*b* that is the surface of the shroud 8 on the first end side is formed by, for example, lathing or the like to form a disc body 32.

In addition, here, although the base material 30 is subjected to lathing or the like so as to form the disc body 32, the disc body 32 may be formed only by forging. Additionally, here, although the cylindrical base material 30 which is formed with the fitting hole 13 and the fixed portion 12 by forging, is adopted, the fitting hole 13 and the fixed portion 12 are subjected to lathing or the like, for example, using a disc-shaped base material.

Figure 8:
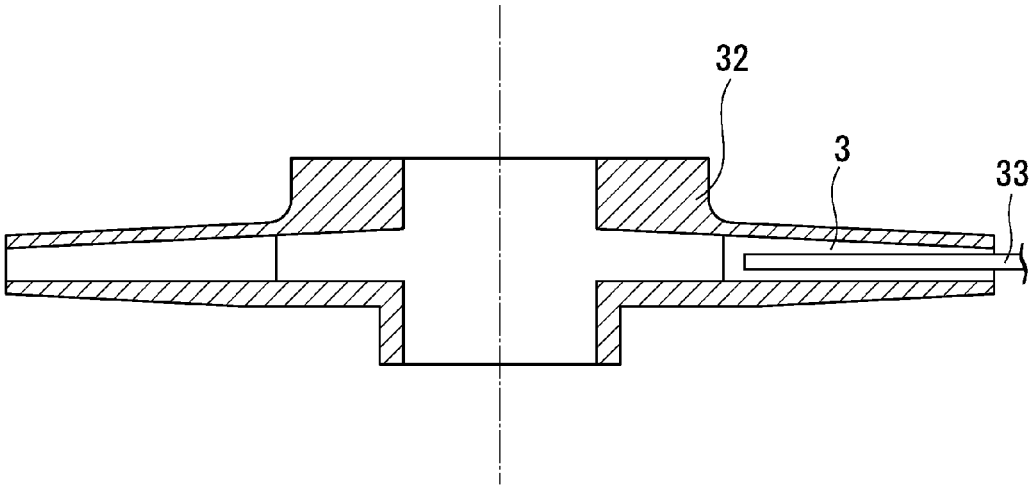
FIG. 8 is a view showing a manufacturing step of the impeller of the embodiment of the present invention.

Next, as shown in FIG. 8, as the cutting step, the flow passage 3 is formed from the outer peripheral side of the disc body 32. Specifically, the flow passage 3 is formed by inserting an electrode 33 corresponding to the shape of the flow passage 3 from a position to be used as an outlet of the flow passage 3, by a spark erosion method.

Here, the electrode 33 is a rectangular elongated member as viewed from the cross-section thereof. Additionally, the electrode 33 has a shape having a height smaller than the height of the flow passage 3, and has a curved shape and a width dimension corresponding to a shape viewed from the axial direction of the flow passage 3. Additionally, the electrode 33 is formed from, for example, graphite, copper, or the like, and is attached to an electrical discharge machine that is not shown.

As for spark erosion, first, the disc body 32 is dipped in, for example, spark erosion oil that is not shown. Next, as shown in FIG. 8, the disc body 32 and the flow passage 3 are relatively moved in the radial direction and the circumferential direction, respectively, while a portion that becomes the flow passage 3 are inserted using the electrode 33. Additionally, the disc body is also moved in the axial direction if necessary, and spark erosion is performed. In addition, in this case, the machining conditions (a current, a voltage, a pulse, and a feed rate) of the spark erosion by the electrode 33 may be appropriately changed.

A plurality of the flow passages 3 are formed by repeatedly carrying out the steps shown above, regarding each flow passage 3 to be formed in the impeller 1.

Figure 9:
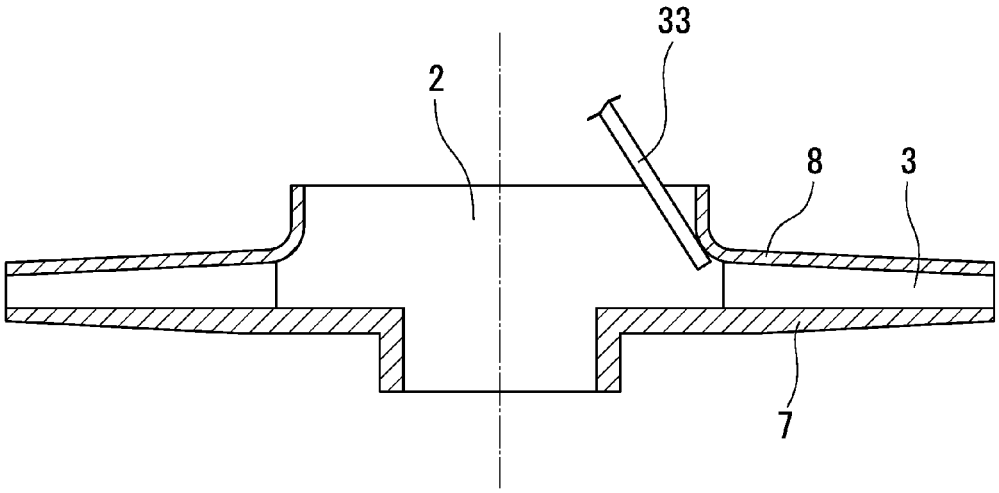
FIG. 9 is a view showing a manufacturing step of the impeller of the embodiment of the present invention.

Next, as shown in FIG. 9, the electrode 33 is inserted from the first end side, and the inner peripheral surface of the shroud 8 is machined.

In addition, in the present embodiment, spark erosion is performed by one type of electrode 33. However, the electrode is not limited to this. For example, roughing, intermediate machining, and finishing may be performed using two or more types of electrodes with different sizes or materials.

Next, in the second member forming step, the second member 5 (refer to FIG. 5) is formed by performing lathing of the cylindrical base material. In the second member forming step, the outer peripheral surface 16 that has the curved increased diameter surface 18 that goes to the radial outer peripheral side is formed as it goes from the second direction to the first direction in the axial direction in the second member 5.

In addition, not only the second member 5 may be obtained by performing lathing of the base material but the second member 5 may be formed only by forging.

According to the above embodiment, the shape of the flow passage 3 formed by the blades 6, the disc 7, and the shroud 8 of the first member 4 forms a substantially straight shape as viewed from the circumferential direction. Therefore, the spark erosion using the straight electrode 33 becomes easier. Since the second member 5 equivalent to a hub portion of related art for directing the air introduced in the axial direction to the radial direction is a separate member, machining of the introduction port 2 in the vicinity of the impeller 1 becomes easier.

In other words, when the flow passage 3 of the first member 4 is formed by splitting the impeller 1 into the first member 4 and the second member 5 and making the second member 5 into a part that constitutes the portion of the disc 7 on the first end side, the accessibility of the electrode 33 improves. That is, when the electrode 33 is inserted from a position to be used as the outlet of the flow passage 3, the machining when forming the flow passage 3 becomes easy by making a part that becomes an interference object on the inner peripheral side into a separate second member 5. Additionally, when the electrode 33 is inserted from a position to be used as the introduction port 2 that is the inlet of the flow passage 3, the machining of the introduction port 2 becomes easy by making a part that becomes an interference object on the second end side into a separate second member 5. Thereby, the manufacturing time can be shortened, and the manufacturing costs can be kept down.

Additionally, since the fluid introduced into the impeller 1 can be guided to the flow passage 3 without any delay by the increased diameter surface 18 in the second member 5, the compression performance of the impeller 1 can be maintained.

Additionally, since the first member 4 and the second member 5 are separately shrink-fitted and fixed to the rotating shaft S, respectively, the impeller 1 can be more firmly fixed to the rotating shaft S as compared to a case where any member is fixed to the rotating shaft S after the first member 4 and the second member 5 are integrated.

Additionally, the surface of the blades 6 that forms the flow passage 3 are formed so as to be orthogonal to the disc 7 whereby the shape of the blades 6 are further simplified as compared to a shape where the surfaces of the blades 6 that form the flow passage 3 inclines with respect to the disc 7. Therefore, the man-hours of machining when the flow passage 3 is formed can be further reduced.

In addition, the technical scope of the present invention is not limited to the above embodiment, and various changes can be made without departing from the scope of the present invention.

Figure 10:
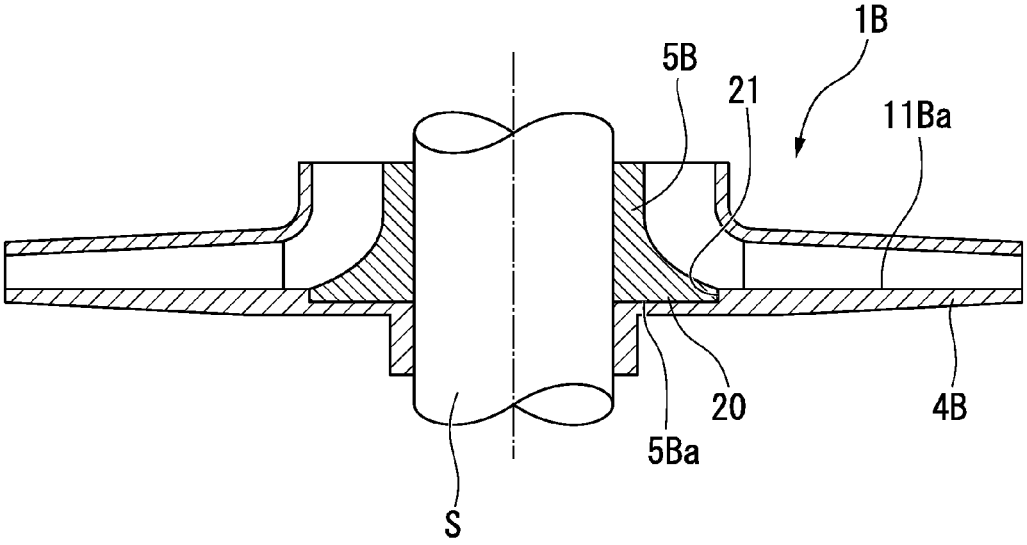
FIG. 10 is a cross-sectional view showing another form of the impeller of the embodiment of the present invention.

In the above embodiment, the other end surface 5*a* of the second member 5 and the one surface 11*a* of the first member 4 are made into substantially flat surfaces, respectively. In contrast, as shown in FIG. 10, a configuration in which the other end surface 5Ba of a second member 5B that constitutes an impeller 1B is provided with a convex portion 20 of a shape that extends the other end surface 5Ba to the second end side, and a concave portion 21 corresponding to the convex portion 20 is provided in one surface 11Ba of a first member 4B may be adopted.

Here, although the second member 5B and the first member 4B are fixed by shrink-fitting or the like in the other end surface 5Ba of the second member 5B, it is not necessary to fix the second member 5B and the rotating shaft S.

Since the outer peripheral side of the other end surface 5Ba of the second member 5B does not have a thin-walled shape in such a configuration, machining of the second member 5B becomes easy.

Figure 11:
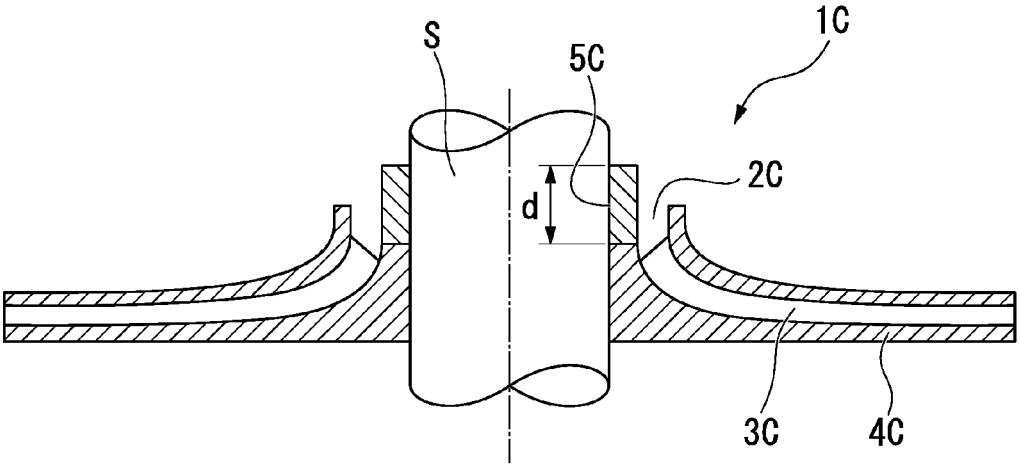
FIG. 11 is a cross-sectional view showing still another form of the impeller of the embodiment of the present invention.
Figure 12:
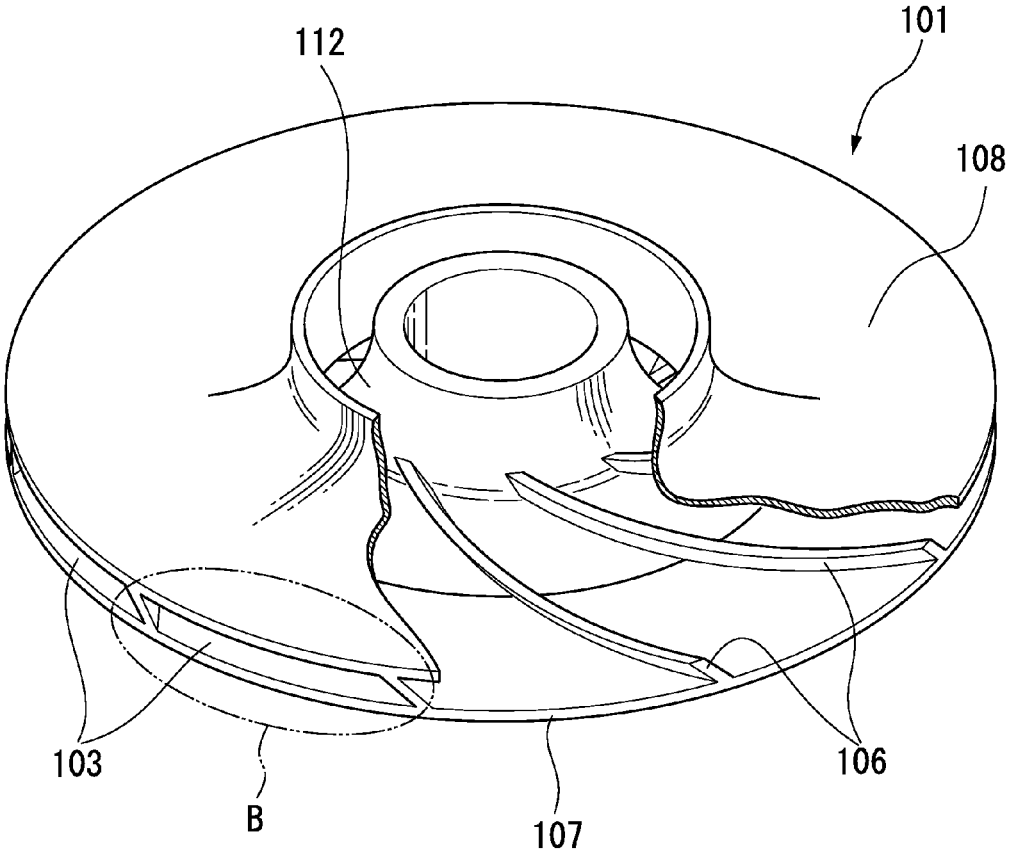
FIG. 12 is a perspective view showing an impeller of the related art.
Figure 13:
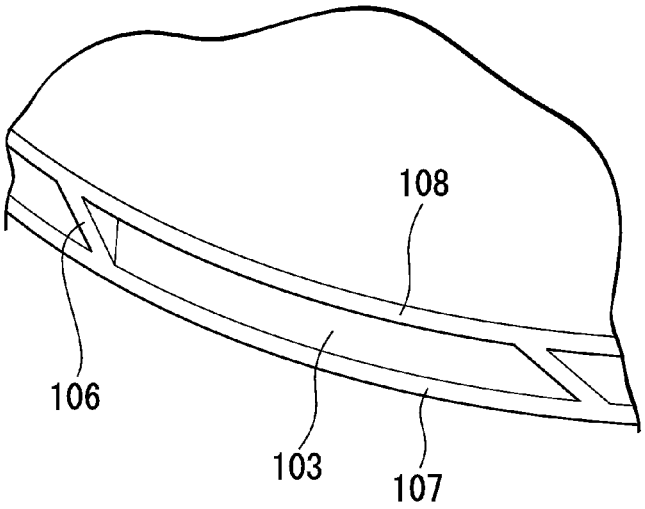
FIG. 13 is an enlarged view of a part B of FIG. 12.
Figure 14:
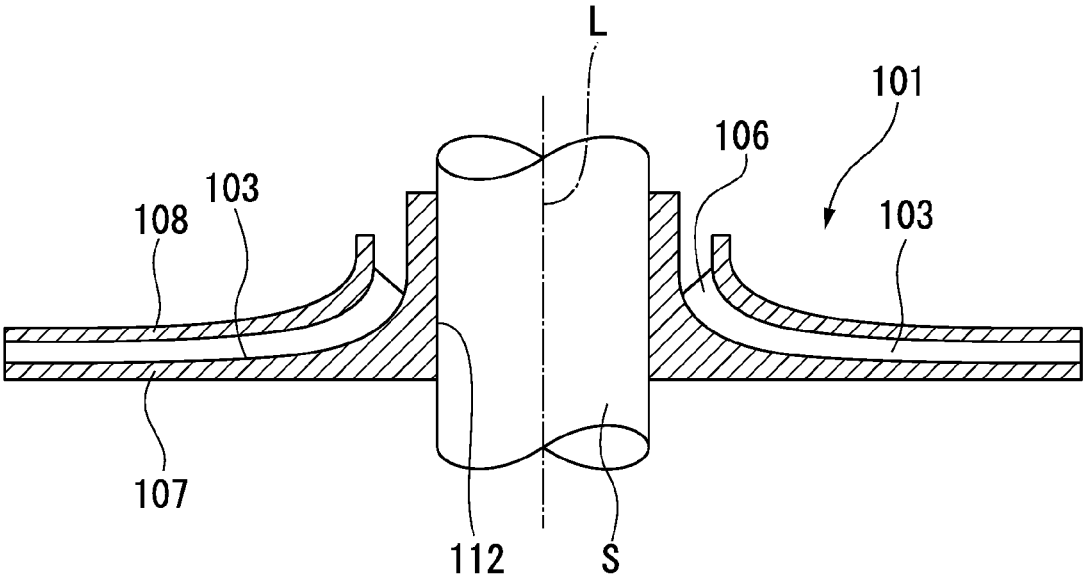
FIG. 14 is a cross-sectional view of the impeller of the related art.

Additionally, as shown in FIG. 11, the first member 4C that constitutes the impeller 1C is not necessarily provided with a fixed portion that extends to the second side of the disc 7C. In the case of this form, it is preferable that the dimension d from the end portion of the second member 5C on the second end side be as great as possible within a range where the fixation strength between the first member 4C and the rotating shaft S can be sufficiently secured. As the dimension d is enlarged, the accessibility of a machining member during machining of the flow passage 3C and the introduction port 2C is increased, which is preferable.

Moreover, in FIG. 10, the fixed portion is not necessarily provided even in a case where the second member 5B is, for example, shrink-fitted to the rotating shaft S and the first member 4B.

Additionally, the method for machining the flow passage or the like may not be limited to the spark erosion, and a flow passage or the like may be worked by machining.

INDUSTRIAL APPLICABILITY

According to the impeller of the present invention, the accessibility of a machining tool improves when a flow passage portion of the impeller is formed. Therefore, manufacturing time can be shortened. Additionally, in the impeller of the present invention, manufacturing costs can be kept down.

REFERENCE SIGNS LIST

S: ROTATING SHAFT
1: IMPELLER
3: FLOW PASSAGE
4: FIRST MEMBER
5: SECOND MEMBER
6: BLADE
7: DISC
8: SHROUD
8A: OTHER SURFACE
11: DISC BODY PORTION
11A: ONE SURFACE
12: FIXED PORTION
18: INCREASED DIAMETER SURFACE
50: CENTRIFUGAL COMPRESSOR (ROTARY MACHINE)

The invention claimed is:

1. An impeller including a rotating shaft extending along an axis and having a first end and a second end, a plurality of blades disposed in a circumferential direction of the impeller, in which each of the plurality of blades extends outwardly from an inner peripheral side of the impeller in a radial direction of the impeller and is configured to rotate around the rotating shaft, a shroud located closer to the first end than the plurality of blades, and to which the plurality of blades is attached, a disc configured to be attached to the rotating shaft, and flow passages which are formed by the plurality of blades, the disc and the shroud, the impeller comprising:

a first member which is integrally formed by the plurality of blades, the shroud and a first portion of the disc, and a second member which is a second portion of the disc, wherein:

the first portion is attached to the plurality of blades and at least a part of the first portion is closer to the second end than the second portion, the second portion has a cylindrical member centered on the axis along which the rotating shaft extends, and at least a part of the second portion is closer to the first end than the first portion, and the second portion is provided with a convex portion including a second flat surface facing toward the second end, the first portion is provided with a concave portion corresponding to the convex portion, the concave portion being located on a first flat surface facing toward the first end, a diameter of the second member is smaller than an internal diameter of the shroud of the first member, and the second flat surface is fixed to the first flat surface.

2. The impeller according to claim 1, wherein a shroud surface opposite to the first flat surface is formed into a flat surface.

3. The impeller according to claim 2, wherein the plurality of blades is provided within a range of the first flat surface of the disc, the second flat surface of the disc, or the flat surface of the shroud as viewed from an axial direction.

4. The impeller according to claim 1, wherein a surface of the second member that faces toward the first end is formed in a curved shape so as to extend to a radial outer peripheral side from a first end of the second member toward a second end of the second member.

5. The impeller according to claim 1, wherein the first member has a fixed portion that is fixed to the rotating shaft.

6. The impeller according to claim 1, wherein a surface of each of the plurality of blades that forms the flow passages is formed so as to be orthogonal to a surface of the disc that faces the shroud.

7. A rotary machine comprising the impeller according to claim 1.

8. A method for manufacturing an impeller including a rotating shaft extending along an axis and having a first end and a second end, a plurality of blades disposed in a circumferential direction of the impeller, in which each of the plurality of blades extends outwardly from an inner peripheral side of the impeller in a radial direction of the impeller and is configured to rotate around the rotating shaft, a shroud located closer to the first end than the plurality of blades, and to which the plurality of blades is attached, and a disc configured to be attached to the rotating shaft, and flow passages which are formed by the plurality of blades, the disc, and the shroud, the disc including a first portion which is attached to the plurality of blades, at least a part of the first portion being closer to the second end than the second portion, and a second portion which has a cylindrical member centered on the axis along which the rotating shaft extends, at least a part of the second portion being closer to the first end than the first portion, the method comprising:

performing cutting on a base material for forming a second end side of the impeller to form the flow passages, and forming a first member, the first member being integrally formed by the plurality of blades, the shroud, and the first portion, and extending outwardly from the inner peripheral side of the impeller in the radial direction of the impeller, the first portion being provided with a concave portion, and the concave portion being located on a first flat surface facing toward the first end; and forming a second member which is the second portion, the second portion being provided with a convex portion corresponding to the concave portion, the convex portion including a second flat surface facing toward the second end, wherein a diameter of the second member is smaller than an internal diameter of the shroud of the first member, and wherein the second flat surface is fixed to the first flat surface.

9. The method for manufacturing an impeller according to claim 8, wherein, in the forming of the second member, a surface of the second member that faces toward the first end is formed with a curved portion that extends to a radial outer peripheral side from a first end of the second member toward a second end of the second member.

10. A rotary machine comprising the impeller according to claim 2.

11. A rotary machine comprising the impeller according to claim 3.

12. A rotary machine comprising the impeller according to claim 4.

13. A rotary machine comprising the impeller according to claim 5.

14. A rotary machine comprising the impeller according to claim 6.

* * * * *